US012163771B2

(12) United States Patent
Durden et al.

(10) Patent No.: US 12,163,771 B2
(45) Date of Patent: Dec. 10, 2024

(54) ARMING AND DISARMING MUNITION WITH REDUNDANT SAFETY FEATURE TO RETURN MUNITION TO A SAFE, UNARMED STATE

(71) Applicant: Day & Zimmermann, Inc., Philadelphia, PA (US)

(72) Inventors: David Durden, Texarkana, TX (US); Samuel Giles, Texarkana, TX (US)

(73) Assignee: DAY & ZIMMERMANN, INC., Philadelphia, PA (US)

( * ) Notice: Subject to any disclaimer, the term of this patent is extended or adjusted under 35 U.S.C. 154(b) by 8 days.

(21) Appl. No.: 18/127,136

(22) Filed: Mar. 28, 2023

(65) Prior Publication Data

US 2023/0324159 A1 Oct. 12, 2023

Related U.S. Application Data

(60) Provisional application No. 63/324,477, filed on Mar. 28, 2022.

(51) Int. Cl.
*F42C 15/44* (2006.01)
*F42C 19/06* (2006.01)

(52) U.S. Cl.
CPC ..... *F42C 15/44* (2013.01); *F42C 19/06* (2013.01)

(58) Field of Classification Search
CPC ..... F42C 15/44; F42C 19/06
USPC ..... 102/254
See application file for complete search history.

(56) References Cited

U.S. PATENT DOCUMENTS

| | | | | |
|---|---|---|---|---|
| 7,040,234 | B1 * | 5/2006 | Maurer | F42C 15/184 102/221 |
| 7,055,437 | B1 * | 6/2006 | Robinson | F42C 15/184 102/222 |
| 7,316,186 | B1 * | 1/2008 | Robinson | F42C 15/24 102/251 |
| 10,648,785 | B1 * | 5/2020 | Lucas | F42D 5/04 |
| 2003/0024427 | A1 * | 2/2003 | Alculumbre | F42C 15/24 102/249 |

* cited by examiner

*Primary Examiner* — Samir Abdosh
(74) *Attorney, Agent, or Firm* — Troutman Pepper Hamilton Sanders LLP

(57) ABSTRACT

A munition with redundant safety features to return the munition to a safe, unarmed state, the munition includes an encasement, an energetic within the encasement, an electronic initiator configured to initiate a detonation of the energetic, wherein the electronic initiator is configured to be discharged to prevent detonation of the energetic, and a mechanical safety assembly configured to be selectively moved from an unarmed position to an armed position, wherein in the armed position the mechanical safety assembly provides a physical barrier between the energetic and the electronic initiator to prevent detonation of the energetic, wherein in the armed position in the mechanical safety assembly provides a pathway between the energetic and the electronic initiator.

20 Claims, 16 Drawing Sheets

ARMING AND DISARMING MUNITION WITH REDUNDANT SAFETY FEATURE TO RETURN MUNITION TO A SAFE, UNARMED STATE

CROSS-REFERENCE TO RELATED APPLICATION

This application claims the benefit of U.S. Provisional Application Ser. No. 63/324,477 titled Arming and Disarming Munition with Redundant Safety Feature to Return Munition to a Safe, Unarmed State filed Mar. 28, 2022, which is hereby incorporated herein by reference in its entirety.

BACKGROUND

A munition's fuze causes the munition to explode. Fuzes often have features to avoid inadvertent detonation. Conventional fired and gun-launched munitions have different arming conditions (called arming environments) than munitions that are not fired or gun-launched, like drones and unmanned aerial vehicles. For example, a fired or gun-launched munition will experience high acceleration causing, for example, a high G-load setback and/or a high spin from spin stabilization. Setback refers to the force a fuzed item experiences after being fired from a weapon, such as a grenade launcher or artillery piece. Spin refers to rotational force experienced by a fuzed item after being fired. Spin is caused by either weapon rifling or from fins on the item as the item travels through the air. Munition that is not fired or gun-launched will not experience those same forces, and thus has a very different arming condition. As a result, conventional fuzes for fired and gun-launched munitions are not effective for use in munitions that are not fired or gun-launched, such as, for example, drones and vertical takeoff and landing munitions that are themselves the munition.

Another problem with fuzes for conventional fired or gun-launched munitions is that they do not permit a fired munition to be returned in an unarmed state; once the munition is fired, it must detonate. It would be desirable if a fuze could allow a munition to arm and then return to a disarmed state without detonation. It would further be desirable if the armed and disarmed munition could be re-armed and detonated after an initial abandoned charging. This would avoid wasting equipment when the decision to engage a target is abandoned.

It would further be desirable if the fuze had redundant safety features and could provide an indication to the user that the munition cannot detonate. It would further be desirable if the fuze had mechanical safety features.

The present disclosure is directed to overcoming these and other problems of the prior art.

SUMMARY

Embodiments of the present invention address and overcome one or more of the above shortcomings and drawbacks, by providing methods, systems, and apparatuses related to an arming and disarming munition with redundant safety feature to return munition to a safe, unarmed state. Additional features and advantages of the invention will be made apparent from the following detailed description of illustrative embodiments that proceeds with reference to the accompanying drawings.

In an exemplary embodiment, a munition with redundant safety features to return the munition to a safe, unarmed state includes an encasement; an energetic within the encasement; an electronic initiator configured to initiate a detonation of the energetic, wherein the electronic initiator is configured to be discharged to prevent detonation of the energetic; and a mechanical safety assembly configured to be selectively moved from an unarmed position to an armed position, wherein in the armed position the mechanical safety assembly provides a physical barrier between the energetic and the electronic initiator to prevent detonation of the energetic, wherein in the armed position in the mechanical safety assembly provides a pathway between the energetic and the electronic initiator.

In some embodiments, the mechanical safety assembly can further be selectively moved from the armed position to a locked position and from the locked position to the unarmed position, and the mechanical safety assembly further includes a locking assembly configured to provide a physical barrier preventing the mechanical safety assembly from moving from the locked position to the armed position without a manual override. In some embodiments, the munition further includes a coupling piece between the energetic and the electronic initiator, wherein the coupling piece forms therethrough a firing train aperture. In some embodiments, the mechanical safety assembly further includes a slide that can be selected moved in a slide channel from the unarmed position to the armed position, wherein the slide forms within it a slide aperture therethrough; and an actuator, wherein the actuator is configured to move the slide from the unarmed position to the armed position, wherein, in the armed position, the slide aperture is aligned with the firing train aperture such that the slide aperture and the firing train aperture form the pathway between the energetic and the electronic initiator, and wherein, in the unarmed position and the locked position, the slide aperture is not aligned with the firing train aperture such that the slide provides a physical barrier between the energetic and the electronic initiator to prevent detonation of the energetic. In some embodiments, in the unarmed position and the armed position, the locking assembly is within a locking space formed within the coupling piece, and in the locked position, the locking assembly is at least partly outside of the locking space such that the locking assembly prevents the mechanical safety assembly from moving from the locked position to the armed position. In some embodiments, the munition further includes a sensor configured to sense when the mechanical safety assembly is in the locked position; and an indicator configured to alert a user that the mechanical safety assembly has at least partially existed the locking space. In some embodiments, the locking assembly includes a locking plunger; and a spring having a first end connected to the locking plunger and a second end connected a wall of the locking space, wherein in the unarmed position and the armed position, the spring is at least partially compressed. In some embodiments, the munition further includes a sensor configured to sense when the locking plunger is at least partly outside of the locking space; and an indicator configured to alert a user when the locking plunger is at least partly outside of the locking space such that the mechanical safety assembly is in the locked position and the munition is safe to handle. In some embodiments, the munition further includes a booster pellet with the slide aperture. In some embodiments, the actuator is configured to move the slide linearly. In some embodiments, the mechanical safety assembly further includes a pin about which the slide can rotate, wherein the actuator is configured to rotate the slide about the pin. In some embodiments, the electronic initiator is initiated by one or more of heat, friction, and spark. In some embodiments, the electronic initiator includes a low energy exploding foil initiator (LEEFI) with a flyer.

In an exemplary embodiment, an initiator with redundant safety features for used in a munition includes an electronic initiator configured to initiate a detonation of an energetic, wherein the electronic initiator is configured to be discharged to prevent detonation of the energetic; a coupling piece configured to be placed between an energetic and an electronic initiator, wherein the coupling piece forms therethrough a firing train aperture; and a mechanical safety assembly configured to be placed between the electronic initiator and the coupling piece, wherein the mechanical safety assembly can be selectively moved from an unarmed position to an armed position, wherein in the unarmed position the mechanical safety assembly provides a physical barrier between the energetic and the electronic initiator to prevent detonation of the energetic, wherein in the armed position in the mechanical safety assembly provides a pathway between the energetic and the electronic initiator.

In some embodiments, the mechanical safety assembly further includes a slide that can be selected moved in a slide channel from the unarmed position to the armed position, wherein the slide forms within it a slide aperture therethrough; and an actuator, wherein the actuator is configured to move the slide from the unarmed position to the armed position, wherein, in the armed position, the slide aperture is aligned with the firing train aperture such that the slide aperture and the firing train aperture form the pathway between the energetic and the electronic initiator, and wherein, in the unarmed position, the slide aperture is not aligned with the firing train aperture such that the slide provides a physical barrier between the energetic and the electronic initiator to prevent detonation of the energetic. In some embodiments, the mechanical safety assembly can further be selectively moved from the armed position to a locked position and from the locked position to the unarmed position, and the mechanical safety assembly further includes a locking assembly configured to provide a physical barrier preventing the mechanical safety assembly from moving from the locked position to the armed position without a manual override. In some embodiments, wherein in the unarmed position and the armed position, the locking assembly is within a locking space formed within the coupling piece; wherein in the locked position, the locking assembly is at least partly outside of the locking space and at least partly within the slide channel such that the locking assembly prevents the mechanical safety assembly from moving from the locked position to the armed position. In some embodiments, the locking assembly includes a locking plunger; and a spring having a first end connected to the locking plunger and a second end connected a wall of the locking space, wherein in the unarmed position and the armed position, the spring is at least partially compressed.

In an exemplary embodiment, a method of returning a munition in an armed state to an unarmed state includes providing a munition in an unlocked unarmed state; arming the munition; unarming the munition; locking the munition in a locked unarmed state; overriding the locked unarmed state of the munition; returning the munition to the unlocked unarmed state; and arming the munition.

In some embodiments, the method further includes detonating the munition.

This summary is provided to introduce a selection of concepts in a simplified form that are further described below in the detailed description. This summary is not intended to identify key features or essential features of the claimed subject matter, nor is it intended to be used to limit the scope of the claimed subject matter. Additional features and advantages of the disclosed technology will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

The subject matter disclosed herein relates to an arming and disarming munition with redundant safety feature to return munition to a safe, unarmed state. The munition includes two safety features: an electronic safe and arm device (ESAD) and an electromechanical safe and arm device (EMS). The ESAD may contain a capacitor bank that can be charged to arm the munition. Bleeding the capacitor bank will render the munition incapable of self-ignition and safe for an use to handle. The EMS may contain a slide with a slide hole. Moving the slide hole out of line with the firing train will render the munition incapable of self-ignition and safe for a user to handle.

The arming and disarming munition disclosed herein has several advantages. For example, this configuration permits the munition to be armed for detonation and safely returned to a disarmed state rather than detonating. Later, the munition may be rearmed. In other words, if a target is identified and the munition is armed, the target may be abandoned, and the munition may return to a disarmed state without detonated. This avoids wasting equipment when a target is abandoned. For another example, the EMS may further include a lock plunger to prevent the slide hole from realigning with the firing train. This provides a tactile indication that the munition is safe for a user to handle and can be connected to a sensor to indicate its status to a user. The additional advantages of the disclosed subject matter will be made apparent from the following detailed description of illustrative embodiments that proceeds with reference to the accompanying drawings.

Figure 1:
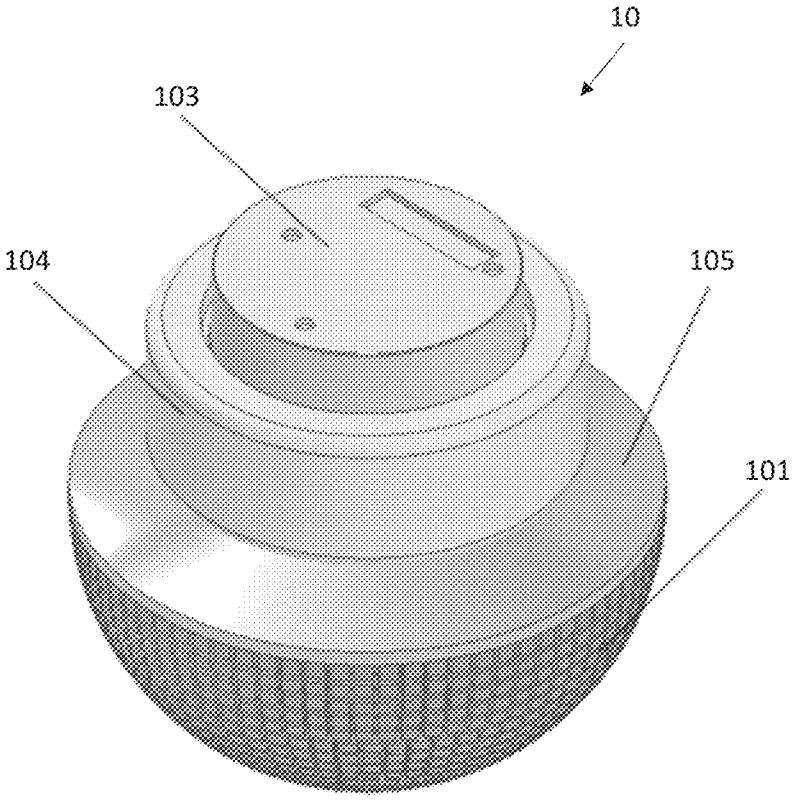
FIG. 1 is an embodiment of an arming and disarming munition with redundant safety feature to return munition to a safe, unarmed state.

FIG. 1 is an embodiment of an arming and disarming munition with redundant safety feature to return munition to a safe, unarmed state. In FIG. 1, an arming and disarming munition with redundant safety feature to return munition to a safe, unarmed state 10 is used with a warhead. The warhead comprises a frag body 101. The frag body 101 is made of etched metal and comprises a main energetic 102 within it. Upon explosion of the main energetic 101, the frag body 102 will fracture along the etching to create shrapnel, and the shrapnel will burst outward from the explosion. The warhead shown in FIG. 1 also has an ESAD-to-fuse adapter claim 104 and a fuze-to-body adapter 105. Although FIG. 1 shows a fragmentation type warhead, the subject matter disclosed herein is not so limited. Instead, the systems and methods herein will work with other types of warheads.

Detonation of the main energetic 102 is initiated by an initiator. In some embodiments, the initiator is an electronic safe and arm device (ESAD) 103. The ESAD 103 may be controlled by a processor. The ESAD 103 may comprise a capacitor bank that, when charged, charges the ESAD 103 and makes it sensitive to the detonation method. The ESAD 103 may contain a low energy exploding foil initiator (LEEFI) to initiate the detonation. A LEEFI operates by turning a piece of material, usually copper, into a plasma gas. The plasma gas accelerates a flyer, which is typically a plastic material. The flyer travels at a high velocity and impacts an explosive. The high velocity impact will initiate the explosive. The detonation of the ESAD 103 will detonate a main energetic 102 inside the frag body 101, causing an explosion. In another embodiment, the ESAD 103 may detonate a booster pellet, which in turn will detonate the main energetic 102. The ESAD 103 may be capable of providing to the user feedback indicating its arming status.

In some embodiments, the ESAD 103 may comprise additional sensors that permit the munition to detonate based on sensed conditions. For example, a charged ESAD 103 may be designed for proximity, sensor fuzed, impact, and timed self-destruction detonation. In an embodiment, the ESAD 103 may comprise an accelerometer such that the munition is set to detonate when it experiences the acceleration change caused by impact. Further, the ESAD 103 could be set to detonate based on a time delay. For example, the ESAD 103 may be designed to detonate several milliseconds after impact. For another example, the ESAD 103 may comprise a proximity sensor.

The ESAD 103 may include a resistance bleed-down on the LEEFI. When the firing capacitor of an ESAD 103 is bled down after losing power feed, it discharges at a designed rate to render the unit unable to function. The bleed down time may be, for example, 30 seconds. Feedback of this status can be sent back to the user for their awareness.

Other initiators are possible, as long as the energetic is sensitive to the initiation. Some energetics may be initiated by heat, friction, or spark. In some embodiments, an electronic detonator is used instead of an ESAD 103. Electronic detonator produces an arc that arcs out to an explosive that is sensitive to heat, causing an explosion.

Figure 2:
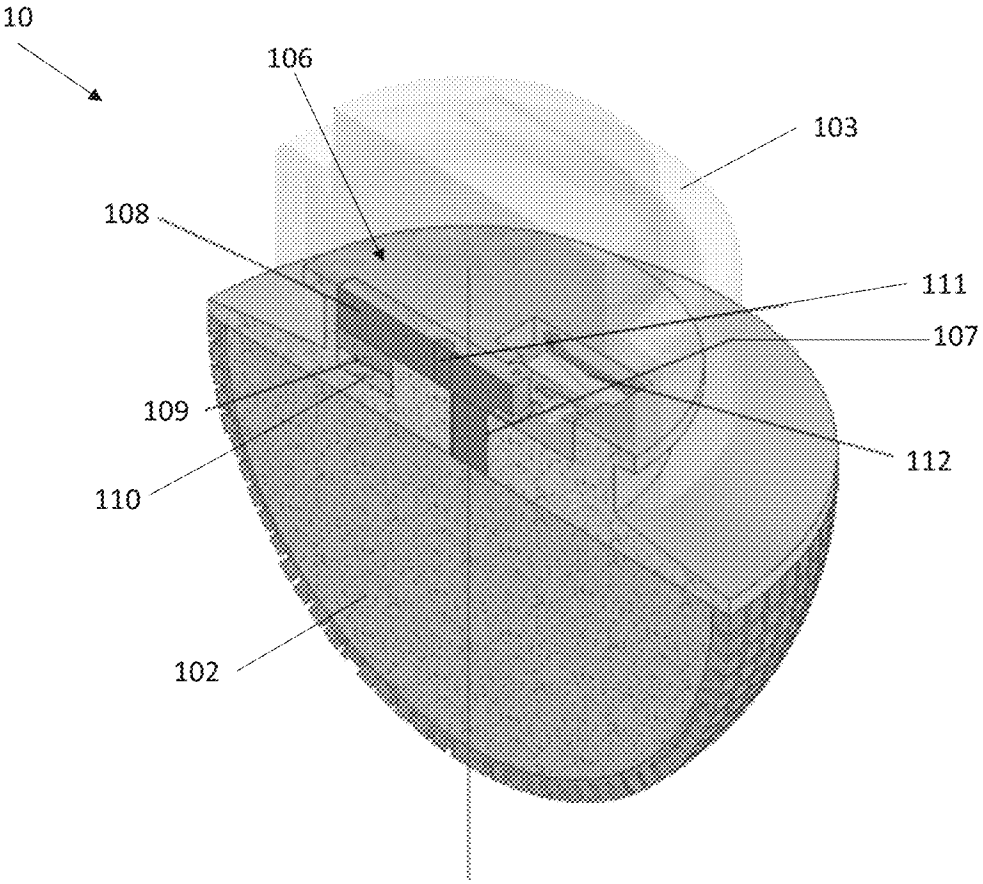
FIG. 2 is a prospective cross-sectional view of an embodiment of an arming and disarming munition with redundant safety feature to return munition to a safe, unarmed state in a disarm position.

FIG. 2 is a prospective cross-sectional view of an embodiment of an arming and disarming munition with redundant safety feature to return munition to a safe, unarmed state in a disarm position. The arming and disarming munition 10 comprises a frag body 101, a main energetic 102 within the frag body 101, an ESAD 103, and an electromechanical safe and arm device (EMS) 106 or a microelectromechanical safe and arm device (MEMS). The ESAD's 103 capacitor bank maybe bled by bleed resistors in a LEEFI capacitor to render the munition 10 safe after a period of time. The ESAD 103 represents a first safety feature. However, because it is very hard to know certainly that an electronic device like an ESAD 103 has been fully discharged, a second safety feature is desirable. The EMS 106 represents a second safety feature. The EMS 106 may operate as a physical barrier to the firing train 107, separating the ESAD 103 and the main energetic 102.

In this embodiment, the firing train 107 between the ESAD 103 and the main energetic 102 is disrupted by the EMS 106 ("out of line"). The EMS 106 may comprise an ESAD 103, a slide 108, an electric actuator to move the slide 108, and a lock plunger 109 with a spring 110. The slide 108 has a hole 111 extending through it. In some embodiments, the slide hole 111 may comprise a booster pellet.

The electric actuator may be a drive motor 112 configured to move the slide 108. The drive motor 112 may be a ball screw driven actuator. This mechanism has several advantages, both mechanically and safety related. The nature of the ball screw means that all positions are "locked" i.e. they can't move without the ball screw rotating. This helps maintain positional integrity during both flight and impact actuation. Use of a positive actuator (instead of a spring) is a more affirmative method of position control of components. They are also light weight. In another embodiment, the electric actuator may be a solenoid and springs that, together, can operate to move the slide.

When the slide hole 111 is aligned with the firing train 107, the firing train 107 is "in line" and the main energetic 102 may detonate if the initiator fired. In some embodiments, when the ESAD 103 is charged and receives a signal to fire, a LEEFI of the ESAD 103 will initiate detonation of the main energetic 102 or, if applicable, the booster pellet. The LEEFI has a foil that, upon firing, will travel ("fly") towards the main energetic 102. The impact of the foil initiates detonation of the main energetic 102. When the slide hole 111 is not aligned with the firing train 107 ("out of line"), the main energetic 102 will not detonate; rather, if the initiator is fired, it will fire into the slide ("self-dudding"). In other words, the initiator will start the firing train, propagating to the main energetic 102, unless blocked by the slide 108.

Figure 3:
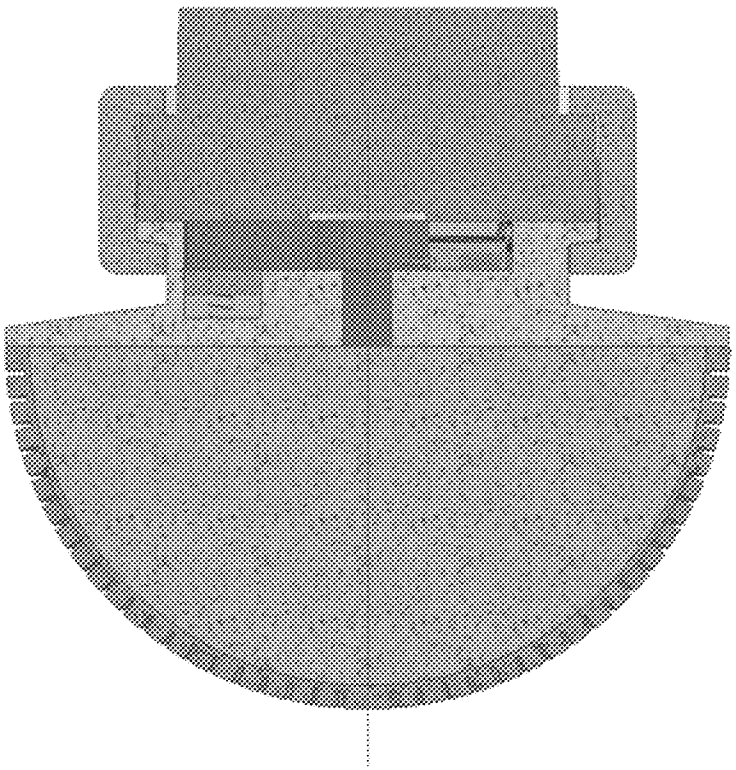
FIG. 3 is a side cross-sectional view of an embodiment of an arming and disarming munition with redundant safety feature to return munition to a safe, unarmed state in a disarm position.

In some embodiments, the EMS 106 may be capable of three positions: a disarm position, an arm position, and a lock position. FIG. 3 is a side view of an embodiment of an arming and disarming munition with redundant safety feature to return munition to a safe, unarmed state in a disarm position.

Figure 4:
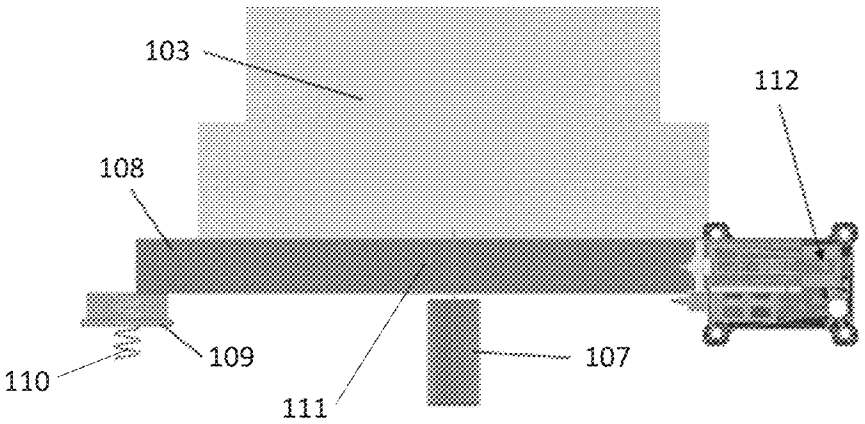
FIG. 4 is a side view of an embodiment of an electromechanical safe and arm device (EMS) in a disarm position.

FIG. 4 is a side view of an embodiment of an EMS 106 in a disarm position. In the disarm position, the slide hole 111 is not aligned with the firing train 107, and the lock plunger 109 is depressed by the slide 108. Because the slide hole 111 is not aligned with the firing train 107 ("out of line"), the main energetic 102 will not detonate if the initiator is fired; rather, if the initiator is fired, it will fire into the slide 108 ("self-dudding").

Figure 5:
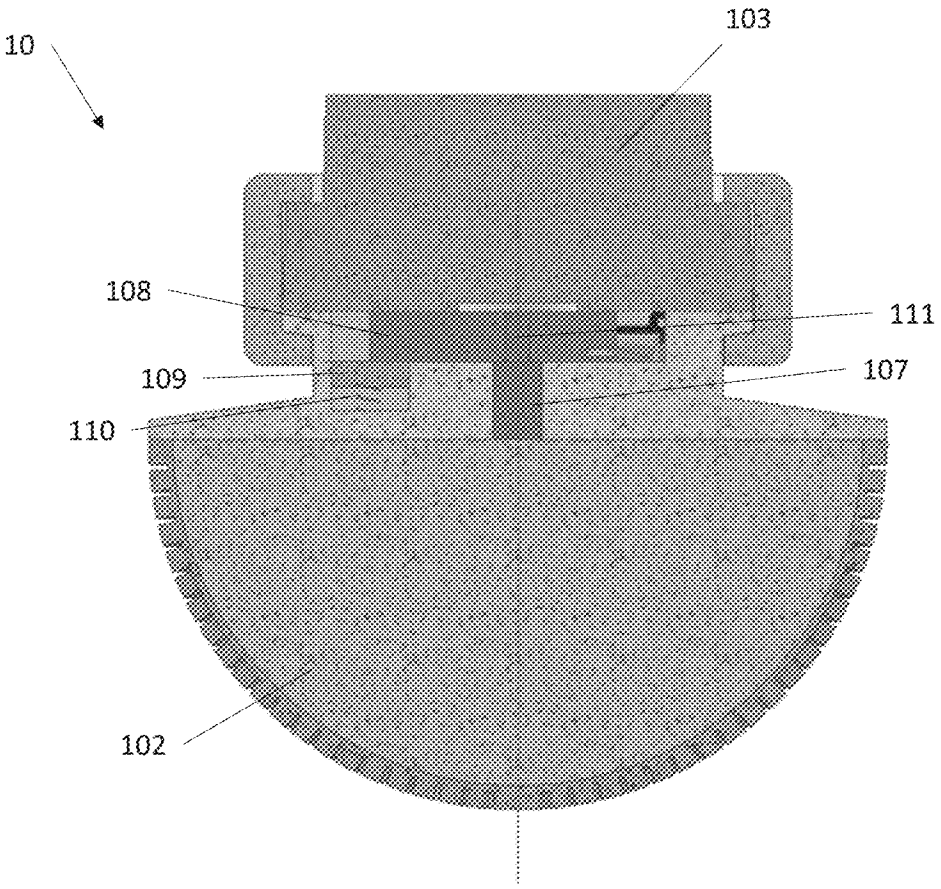
FIG. 5 is a cross-sectional view of an embodiment of an arming and disarming munition with redundant safety feature to return munition to a safe, unarmed state in an arm position.

FIG. 5 is a cross-sectional view of an embodiment of an arming and disarming munition with redundant safety feature to return munition to a safe, unarmed state in an arm position. In this embodiment, the firing train 107 between the ESAD 103 and the main energetic 102 is aligned because the slide hole 111 is aligned with the firing train 107 ("in line"). Because the firing train 107 between the ESAD 103 and the main energetic 102 is aligned, the main energetic 102 may detonate if the initiator fired.

Figure 6:
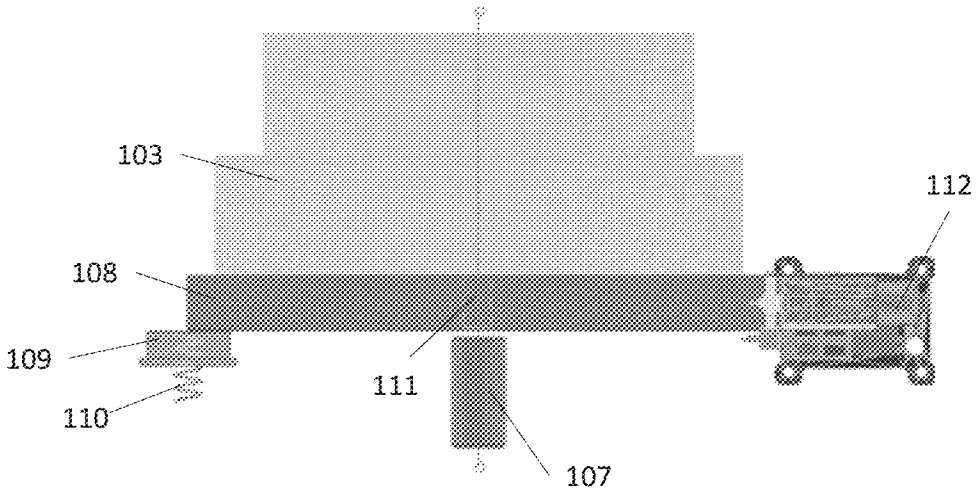
FIG. 6 is a side view of an embodiment of an EMS in an arm position.

FIG. 6 is a side view of an embodiment of an EMS in an arm position, according to an embodiment of the disclosure. In the arm position, the slide hole 111 is aligned with the firing train 107, and the lock plunger 109 is depressed by the slide 108. Because the slide hole 111 is aligned with the firing train 107, the main energetic 102 will detonate if the initiator is fired.

Figure 7:
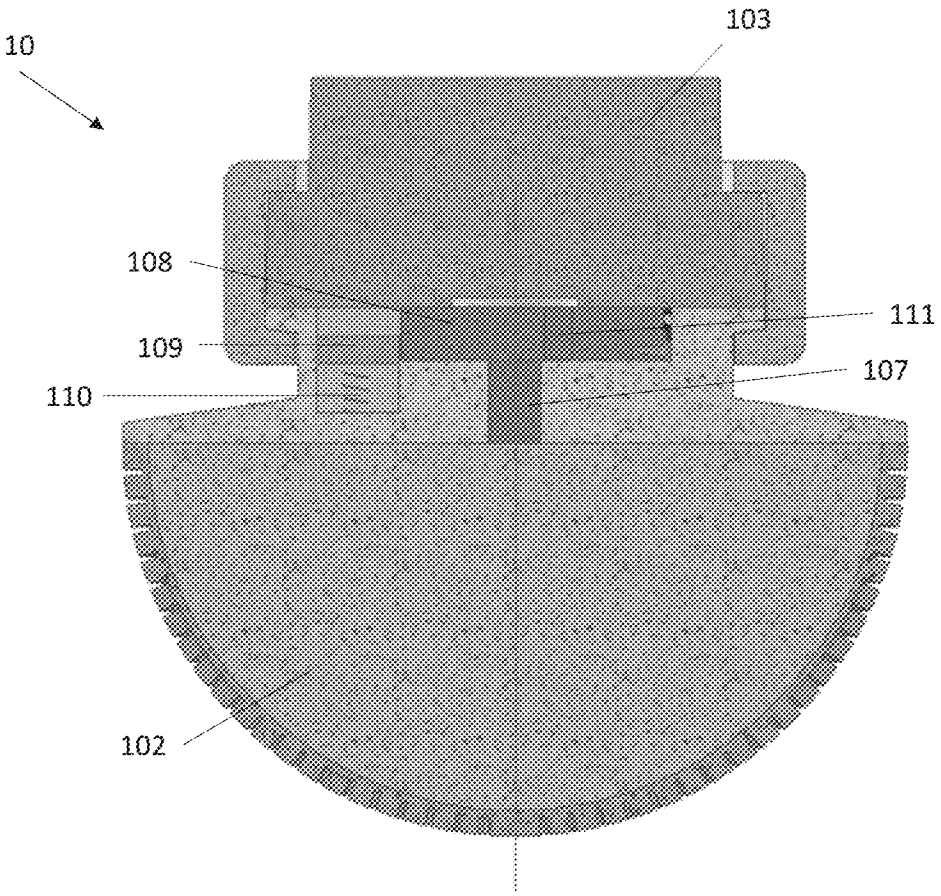
FIG. 7 is a cross-sectional view of an embodiment of an arming and disarming munition with redundant safety feature to return munition to a safe, unarmed state in a lock position.

FIG. 7 is a cross-sectional view of an embodiment of an arming and disarming munition with redundant safety feature to return munition to a safe, unarmed state in a lock position, according to an embodiment of the disclosure. In this embodiment, the firing train 107 between the ESAD 103 and the main energetic 102 is not aligned because slide hole 111 is not aligned with the firing train 107. Further, in the lock position, the lock plunger 109 operates as a physical barrier that prevents the slide 108 from moving to re-align the slide hole 111 with the firing train 107. Because the firing train 107 between the ESAD 103 and the main energetic 102 is not aligned, the main energetic 102 will not detonate if the initiator is fired; rather, if the initiator is fired, it will fire into the slide 108 ("self-dudding").

Figure 8:
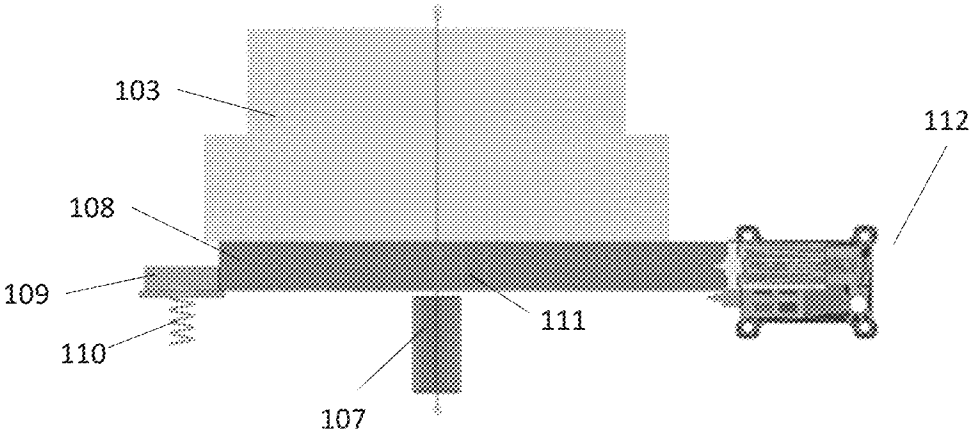
FIG. 8 is a side view of an embodiment of an EMS in a lock position.

FIG. 8 is a side view of an embodiment of an EMS in a lock position, according to an embodiment of the disclosure. In the lock position, the slide hole 111 is not aligned with the firing train 107, and the lock plunger 109 is in its released position and operates as a stop that prevents that slide 108 from aligning the slide hole 111 with the firing train 107. Because the slide hole 111 is not aligned with the firing train 107, the main energetic 102 will not detonate if the initiator is fired; rather, if the initiator is fired, it will fire into the slide 108 ("self-dudding"). In some embodiments, the ESAD 103 may be discharged by bleeding down its capacitor banks so that the ESAD 103 will not detonate. Thus, there are redundant safety features: a physical barrier provided by the EMS 106 via the slide 108 and the electronic draining of the ESAD 103.

In some embodiments, the arming and disarming munition 10 will also include electrical switches or sensors that sense whether or not the lock plunger 109 is compressed. If the lock plunger 109 is depressed, the electrical switch or sensor will indicate to the user that the arming and disarming munition 10 is safe to handle because EMS 106 is disrupting the firing train 107 to prevent the main energetic 102 from detonating.

Figure 9:
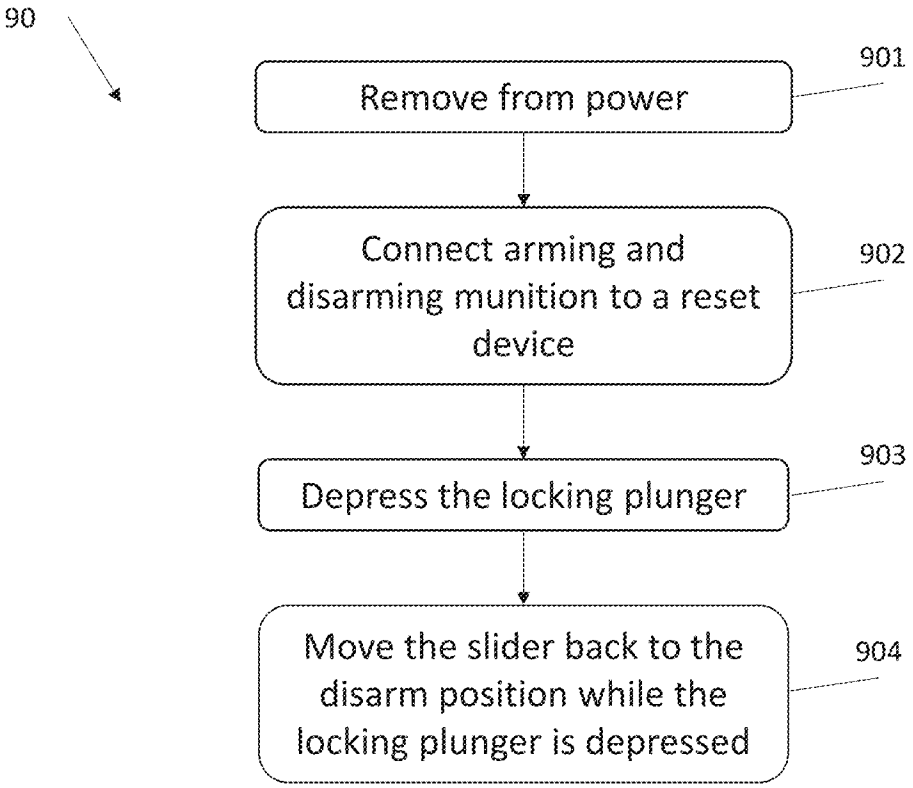
FIG. 9 is a flow chart illustrating an embodiment for returning the arming and disarming munition to the disarm position so it may be reused.
Figure 10A:
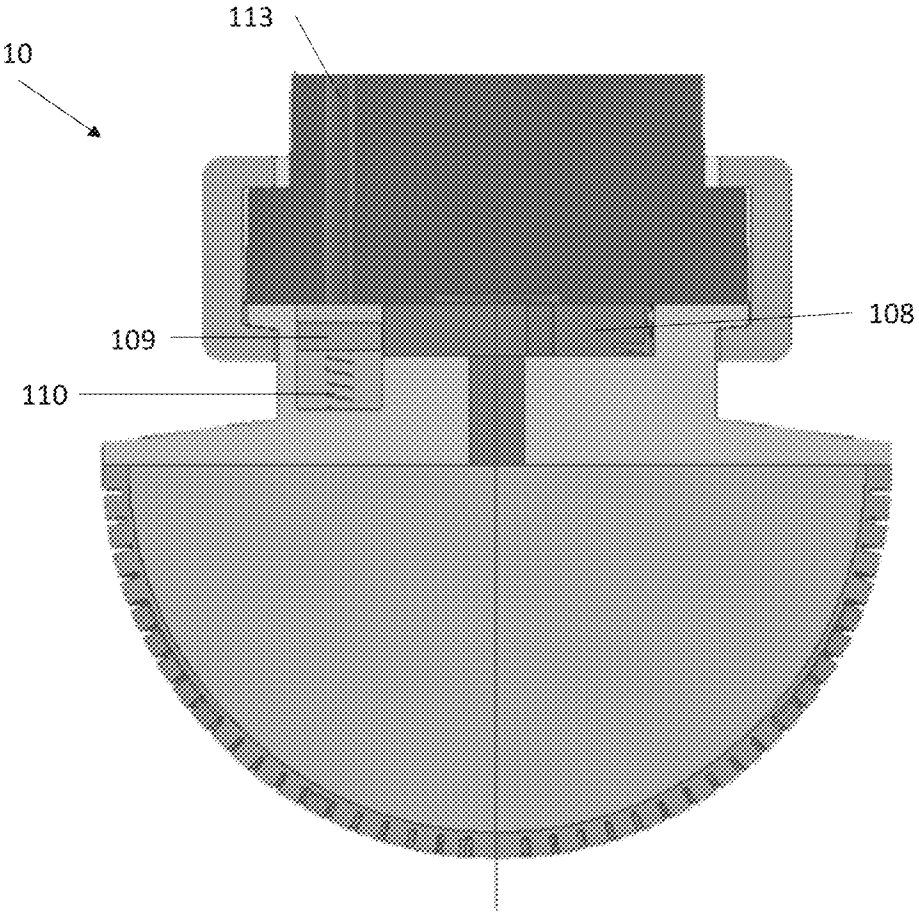
FIGS. 10A-10C illustrate an embodiment of a process of depressing the lock plunger through a hole in an arming and disarming munition with redundant safety feature to return munition to a safe, unarmed stated.
Figure 10B:
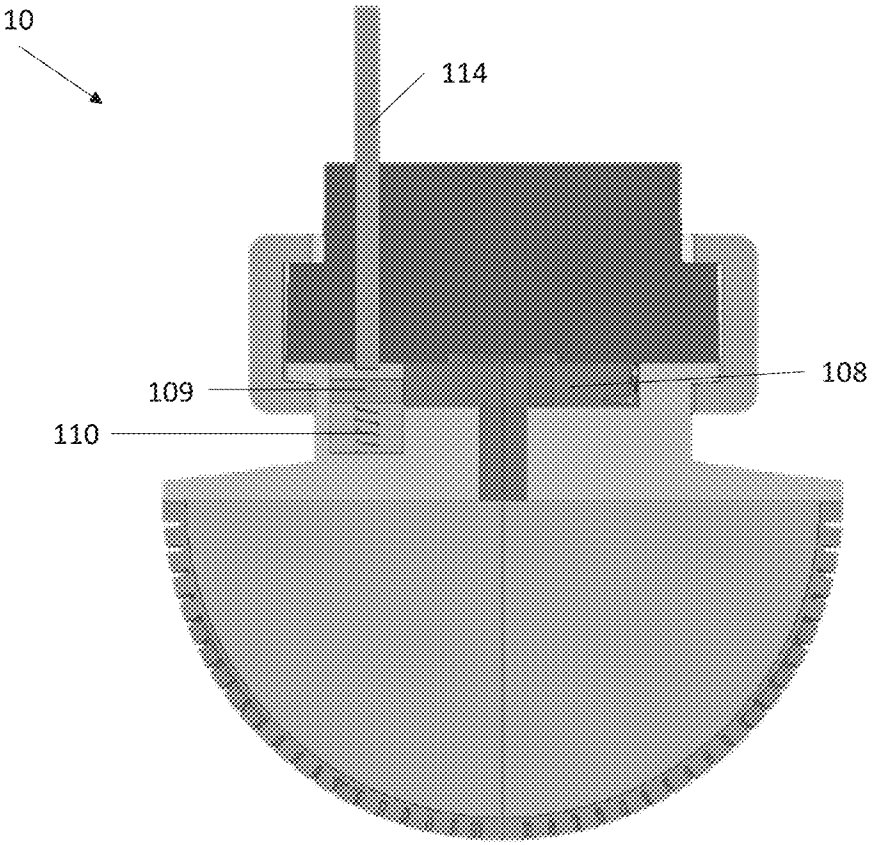
Figure 10C:
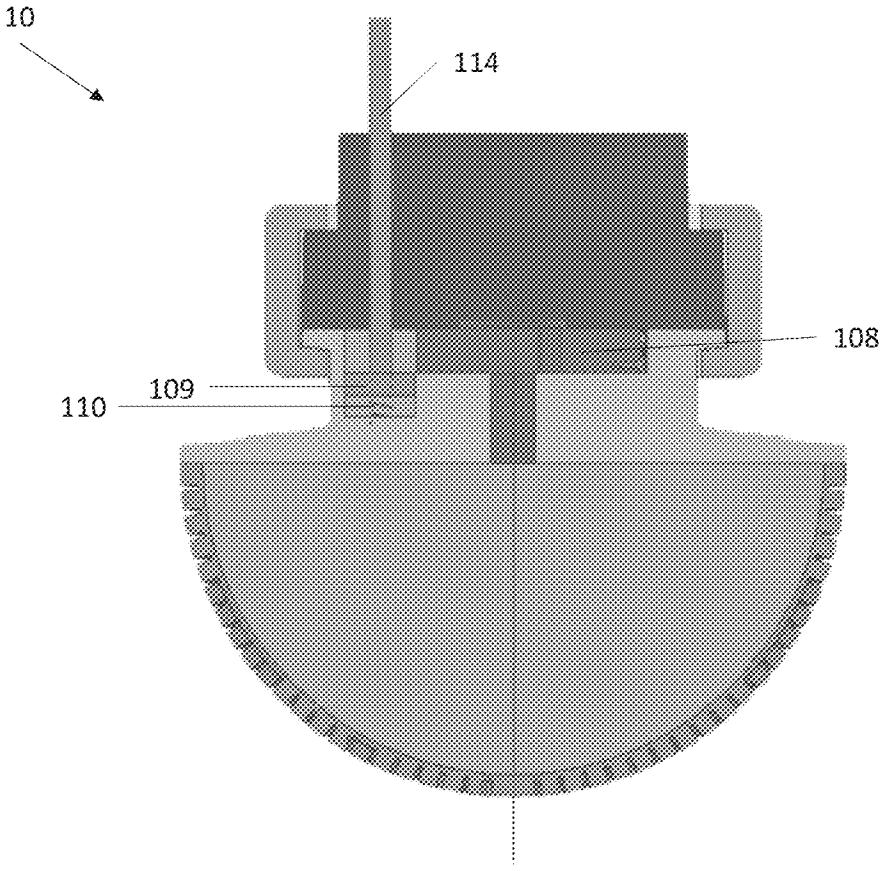

FIG. 9 is a flow chart illustrating an embodiment for returning the arming and disarming munition to the disarm position so it may be reused, according to an embodiment of the disclosure. In an embodiment, the arming and disarming munition 10 may be reused after being put in the arm position. As described above, the arming and disarming munition can be put in the lock position after the arm position. The method to return the arming and disarming munition 10 to the disarm position so that it can be used again may comprise some or all of the following steps. At step 901, the method 90 can include removing the arming and disarming munition from power. At step 902, the method 90 can include connecting the arming and disarming munition to a reset device. In some embodiments, the reset device only has wires to control the actuator, e.g., the drive motor, such that it cannot energize the ESAD 103 or LEEFI. At step 903, the method 90 can include depressing the lock plunger, and, while the lock plunger 109 is depressed, at step 904, the reset device causes the actuator, e.g., the drive motor, to return the slide 108 to the disarm position. The lock plunger 109 may be depressed by the use of a small insert tool (e.g., an ice pick) through a hole in the arming and disarming munition 10, as illustrated in FIGS. 10A-10C. In some embodiments, upon returning the arming and disarming munition 10 to the disarm position, its ESAD 103 may be charged and may be reused for subsequent firing and detonation. This manual resetting increases the safety of the device because it requires intentional physical actions of a user to reset it.

As describe above, the lock plunger 109 may be depressed by the use of a small insert tool (e.g., an ice pick) through a hole in the arming and disarming munition 10. FIGS. 10A-10C illustrate an embodiment of a process of depressing the lock plunger through a hole in an arming and disarming munition with redundant safety feature to return munition to a safe, unarmed stated. FIG. 10A illustrates a cross-sectional view of an embodiment of an arming and disarming munition with a hole 113 through which an insert tool 114 can be inserted to depress the lock plunger 109. FIG. 10B illustrates an insert tool 113 within the hole 114, according to an embodiment of the disclosure. FIG. 10C illustrates the insert tool 113 depressing the lock plunger 109, according to an embodiment of the disclosure.

Figure 11:
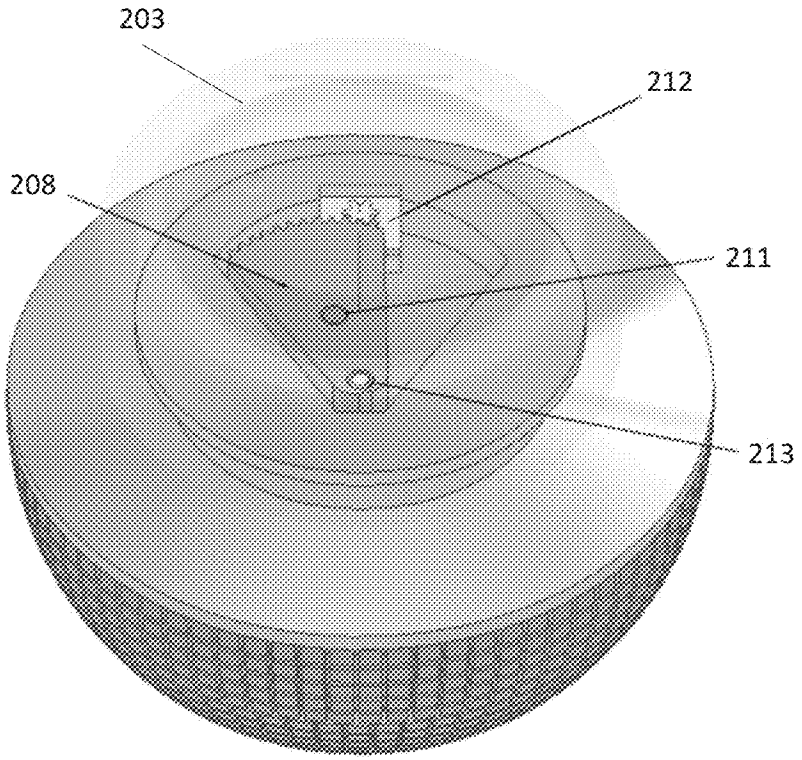
FIG. 11 is an embodiment of an arming and disarming munition with redundant safety feature to return munition to a safe, unarmed state, in a disarm position.

The embodiments shown in FIGS. 2-8 and described above comprise a slide 108 having the shape of a rectangular prism and linear motion that either aligns or removes from alignment a slide hole 111 with the firing train 107. The subject matter disclosed herein is not so limited. The slide 108 may have many different shapes, and the motion can be any motion that takes the slide hole 111 out of alignment with the firing train 107. For example, the movement may be axial, rotational, or pivoting. FIGS. 9-11 illustrate an embodiment of an arming and disarming munition with redundant safety feature to return munition to a safe, unarmed state 20 using a rotator 208 instead of a slide 108.

FIG. 11 is an embodiment of an arming and disarming munition with redundant safety feature to return munition to a safe, unarmed state, in a disarm position, according to an embodiment of the disclosure. In this embodiment, the slide 108 is replaced with a rotator 208 and a pin 213. The rotator 208 has a rotator hole 211 that is not aligned with the firing train 207, and the lock plunger 209 is depressed by the rotator 208. Because the rotator hole 211 is not aligned with the firing train 207, the main energetic 202 will not detonate if the initiator is fired; rather, if the initiator is fired, it will fire into the rotator 208 ("self-dudding").

Figure 12:
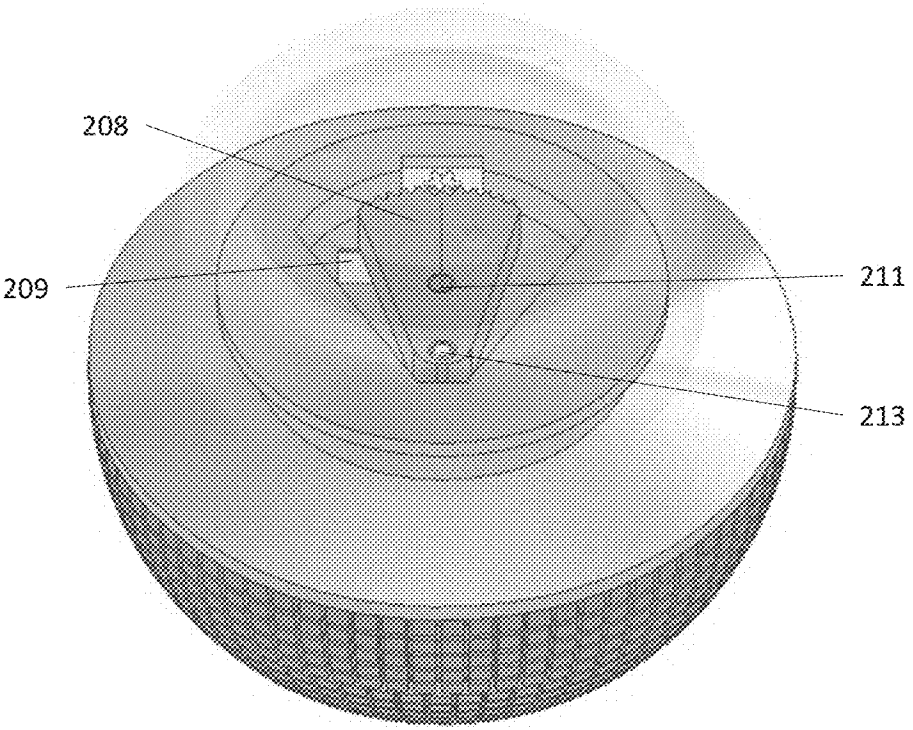
FIG. 12 is an embodiment of an arming and disarming munition with redundant safety feature to return munition to a safe, unarmed state in an arm position.

FIG. 12 is an embodiment of an arming and disarming munition with redundant safety feature to return munition to a safe, unarmed state in an arm position, according to an embodiment of the disclosure. In the arm position, the rotator hole 211 is aligned with the firing train 207, and the lock plunger 209 is depressed by the rotator 208. Because the rotator hole 211 is aligned with the firing train 207, the main energetic 102 will detonate if the initiator is fired. In the embodiment shown in FIG. 12, the rotator 208 is moved by a stepper motor. In some embodiments, the stepper motor may be a micro stepper motor.

Figure 13:
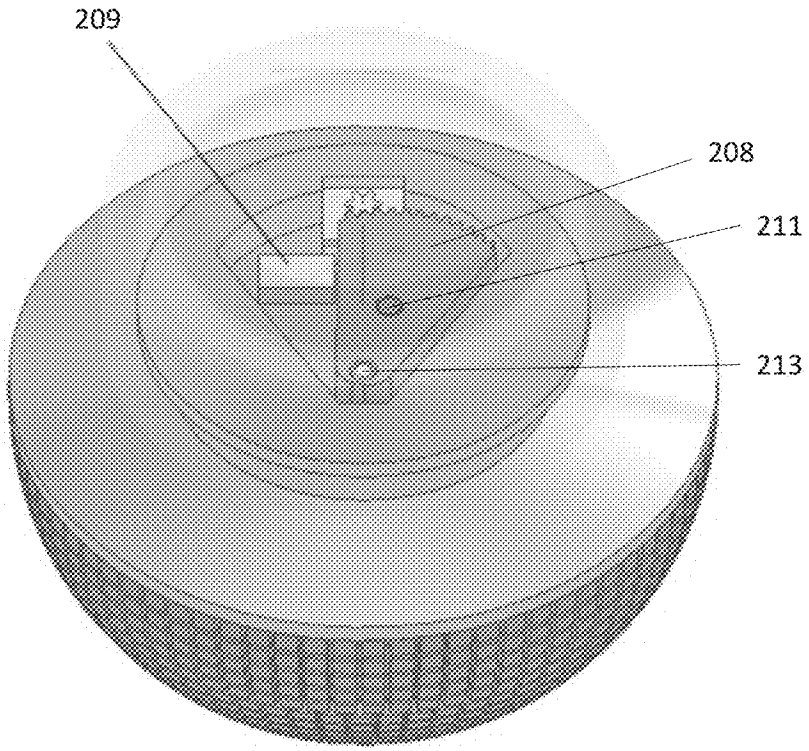
FIG. 13 is an embodiment of an arming and disarming munition with redundant safety feature to return munition to a safe, unarmed state in a lock position.

FIG. 13 is an embodiment of an arming and disarming munition with redundant safety feature to return munition to a safe, unarmed state in a lock position, according to an embodiment of the disclosure. In the lock position, the rotator hole 211 is not aligned with the firing train 207, and the lock plunger 209 is in its released position and operates as a stop that prevents that rotator 208 from aligning the rotator hole 211 with the firing train 207. Because the rotator hole 211 is not aligned with the firing train 207, the main energetic 202 will not detonate if the initiator is fired; rather, if the initiator is fired, it will fire into the rotator 208 ("self-dudding").

The embodiments shown in FIGS. 2-12 and described above comprise a lock plunger and utilize three positions. The subject matter disclosed herein is not so limited. The arming and disarming munition with redundant safety feature to return munition to a safe, unarmed state may not include a lock plunger and may utilize only two positions: a disarm position and an arm position. Instead of utilizing a third "lock position," the arming and disarming munition returns to the original disarm position. In such embodiments the arming and disarming munition does not include a lock plunger or a spring.

The embodiments shown in FIGS. 2-12 and described above comprise an etched body frag container. However, the subject matter disclosed herein is not so limited and the type of subject matter herein is not limited to the type of container. For example, the of fuze safe and arm device disclosed herein could be used on various types of warheads, including, for example and not limitation, blast, fragmentation, shaped charge, and special purpose. For the fragmentation warheads primary fragmentation typically originates from the metallic casing of the warhead. Fragmentation types can be grouped into three categories: natural, pre-fragmented, and pre-formed. Natural fragmenting relies on the explosive detonation to splinter the warhead casing resulting in varying fragment size, shape and mass. Material type, manufacturing method, heat treatment and energetic detonation all affect the fragment sizes and dispersion. Pre-fragmented casings utilize stress risers along predetermined locations of the warhead casing to encourage fragments of a defined size and location. This gives some level of control over the fragmentation size, mass and dispersion. The etched body frag container in our figures is an example of this type. Pre-formed fragments are typically arranged in an epoxy or metal composite matrix forming the warhead casing. Pre-formed fragments often exhibit improved consistency of fragment size, mass and pattern over pre-fragmented casings. The composite matrix manufacturing method also allows use of materials that don't lend themselves to traditional warhead casing manufacturing methods.

Figure 14:
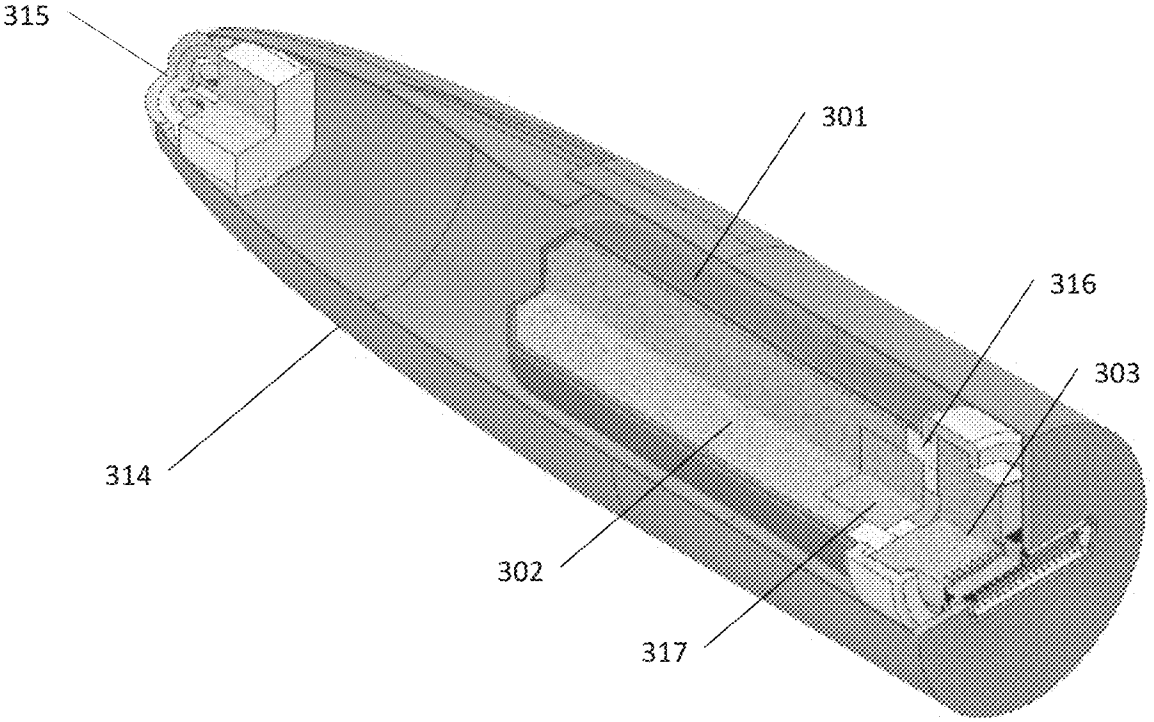
FIG. 14 illustrates a front half of a drone assembly within which the systems and methods described herein may be used.

FIG. 14 illustrates a front half of a drone assembly within which the systems and methods described herein may be used. The back half of the drone assembly has motors and batteries. The drone 30 may include an outer encasement 314 designed for flight characteristics and a front nose camera 315. The warhead within the outer encasement 314 may comprise a warhead housing 301, a main energetic 302, a booster pellet 317, an ESAD 303, and a coupling piece 316. The coupling piece 316 may be made out of aluminum, for example. The coupling piece 316 may comprise the EMS 306 described herein.

The true scope and spirit of the present disclosure is indicated by the following claims. The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Further, this application is intended to cover such departures from the present disclosure that are within known or customary practice in the art to which these teachings pertain. It is also to be understood that the terminology used herein is for the purpose of describing particular embodiments only, and is not intended to be limiting.

Variations of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

In the above detailed description, reference is made to the accompanying drawings, which form a part hereof. In the drawings, similar symbols typically identify similar components, unless context dictates otherwise. It will be readily understood that various features of the present disclosure, as generally described herein, and illustrated in the Figures, can be arranged, substituted, combined, separated, and designed in a wide variety of different configurations, all of which are explicitly contemplated herein.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

We claim:

1. A munition with redundant safety features to return the munition to a safe, unarmed state, the munition comprising:

an encasement;

an energetic within the encasement;

an electronic initiator configured to initiate a detonation of the energetic, wherein the electronic initiator is configured to be discharged to prevent detonation of the energetic; and a mechanical safety assembly configured to be selectively moved from an unarmed position to an armed position, wherein in the unarmed position the mechanical safety assembly provides a physical barrier between the energetic and the electronic initiator to prevent detonation of the energetic, wherein in the armed position in the mechanical safety assembly provides a pathway between the energetic and the electronic initiator.

2. The munition of claim 1, wherein the mechanical safety assembly can further be selectively moved from the armed position to a locked position and from the locked position to the unarmed position, and wherein the mechanical safety assembly further comprises a locking assembly configured to provide a physical barrier preventing the mechanical safety assembly from moving from the locked position to the armed position without a manual override.

3. The munition of claim 2, further comprising:

a coupling piece between the energetic and the electronic initiator, wherein the coupling piece forms therethrough a firing train aperture.

4. The munition of claim 3, wherein the mechanical safety assembly further comprises:

a slide that can be selectively moved in a slide channel from the unarmed position to the armed position, wherein the slide forms within it a slide aperture therethrough; and an actuator, wherein the actuator is configured to move the slide from the unarmed position to the armed position, wherein, in the armed position, the slide aperture is aligned with the firing train aperture such that the slide aperture and the firing train aperture form the pathway between the energetic and the electronic initiator, and wherein, in the unarmed position and the locked position, the slide aperture is not aligned with the firing train aperture such that the slide provides a physical barrier between the energetic and the electronic initiator to prevent detonation of the energetic.

5. The munition of claim 4, wherein in the unarmed position and the armed position, the locking assembly is within a locking space formed within the coupling piece, and wherein in the locked position, the locking assembly is at least partly outside of the locking space such that the locking assembly prevents the mechanical safety assembly from moving from the locked position to the armed position.

6. The munition of claim 5, further comprising:

a sensor configured to sense when the mechanical safety assembly is in the locked position; and an indicator configured to alert a user that the mechanical safety assembly has at least partially existed the locking space.

7. The munition of claim 5, wherein the locking assembly comprises:

a locking plunger; and a spring having a first end connected to the locking plunger and a second end connected a wall of the locking space, wherein in the unarmed position and the armed position, the spring is at least partially compressed.

8. The munition of claim 7, further comprising:

a sensor configured to sense when the locking plunger is at least partly outside of the locking space; and an indicator configured to alert a user when the locking plunger is at least partly outside of the locking space such that the mechanical safety assembly is in the locked position and the munition is safe to handle.

9. The munition of claim 4, further comprises:

a booster pellet with the slide aperture.

10. The munition of claim 4, wherein the actuator is configured to move the slide linearly.

11. The munition of claim 4, wherein the mechanical safety assembly further comprises:

a pin about which the slide can rotate, wherein the actuator is configured to rotate the slide about the pin.

12. The munition of claim 1, wherein the electronic initiator is initiated by one or more of heat, friction, and spark.

13. The munition of claim 1, wherein the electronic initiator comprises a low energy exploding foil initiator (LEEFI) with a flyer.

14. A munition attachment with redundant safety features for use in a munition, the munition attachment comprising:

an electronic initiator configured to initiate a detonation of an energetic, wherein the electronic initiator is configured to be discharged to prevent detonation of the energetic;

a coupling piece configured to be placed between the energetic and the electronic initiator, wherein the coupling piece forms therethrough a firing train aperture; and a mechanical safety assembly configured to be placed between the electronic initiator and the coupling piece, wherein the mechanical safety assembly can be selectively moved from an unarmed position to an armed position, wherein in the unarmed position the mechanical safety assembly provides a physical barrier between the energetic and the electronic initiator to prevent detonation of the energetic, wherein in the armed position in the mechanical safety assembly provides a pathway between the energetic and the electronic initiator.

15. The munition attachment of claim 14, wherein the mechanical safety assembly further comprises:

a slide that can be selectively moved in a slide channel from the unarmed position to the armed position, wherein the slide forms within it a slide aperture therethrough; and an actuator, wherein the actuator is configured to move the slide from the unarmed position to the armed position, wherein, in the armed position, the slide aperture is aligned with the firing train aperture such that the slide aperture and the firing train aperture form the pathway between the energetic and the electronic initiator, and wherein, in the unarmed position, the slide aperture is not aligned with the firing train aperture such that the slide provides a physical barrier between the energetic and the electronic initiator to prevent detonation of the energetic.

16. The munition attachment of claim 15, wherein the mechanical safety assembly can further be selectively moved from the armed position to a locked position and from the locked position to the unarmed position, and wherein the mechanical safety assembly further comprises a locking assembly configured to provide a physical barrier preventing the mechanical safety assembly from moving from the locked position to the armed position without a manual override.

17. The munition attachment of claim 16, wherein in the unarmed position and the armed position, the locking assembly is within a locking space formed within the coupling piece; and wherein in the locked position, the locking assembly is at least partly outside of the locking space and at least partly within the slide channel such that the locking assembly prevents the mechanical safety assembly from moving from the locked position to the armed position.

18. The munition attachment of claim 17, wherein the locking assembly comprises:

a locking plunger; and a spring having a first end connected to the locking plunger and a second end connected to a wall of the locking space, wherein in the unarmed position and the armed position, the spring is at least partially compressed.

19. A munition attachment kit comprising:

a coupling piece configured to be installed between an energetic and an electronic initiator, wherein the coupling piece forms therethrough a firing train aperture; and a mechanical safety assembly configured to be installed between the electronic initiator and the coupling piece, wherein the mechanical safety assembly can be selectively moved from an unarmed position to an armed position, wherein in the unarmed position the mechanical safety assembly provides a physical barrier between the energetic and the electronic initiator to prevent detonation of the energetic, wherein in the armed position in the mechanical safety assembly provides a pathway between the energetic and the electronic initiator.

20. The munition attachment kit of claim 19, the mechanical safety assembly further comprises:

a slide that can be selectively moved in a slide channel from the unarmed position to the armed position, wherein the slide forms within it a slide aperture therethrough; and an actuator, wherein the actuator is configured to move the slide from the unarmed position to the armed position, wherein, in the armed position, the slide aperture is aligned with the firing train aperture such that the slide aperture and the firing train aperture form the pathway between the energetic and the electronic initiator, and wherein, in the unarmed position, the slide aperture is not aligned with the firing train aperture such that the slide provides a physical barrier between the energetic and the electronic initiator to prevent detonation of the energetic.

* * * * *